United States Patent [19]

Huber

[11] 3,975,627

[45] Aug. 17, 1976

[54] BURGLAR-PROOF GUARD FOR LIGHT BULBS

[76] Inventor: Harry J. Huber, 1432 NE. 150th St., North Miami, Fla. 33161

[22] Filed: July 9, 1975

[21] Appl. No.: 594,606

[52] U.S. Cl. ..... 240/102 R; 240/54 R; 240/41.55

[51] Int. Cl.[2] ..... F21V 15/00; F21V 17/00

[58] Field of Search ..... 240/102 R, 102 A, 54 R, 240/54 A, 41.55

[56] References Cited

UNITED STATES PATENTS

| | | | |
|---|---|---|---|
| 914,190 | 3/1909 | Russell | 240/102 A |
| 2,774,049 | 12/1956 | Kibler et al. | 240/102 R X |

FOREIGN PATENTS OR APPLICATIONS

| | | | |
|---|---|---|---|
| 2,048 | 12/1914 | United Kingdom | 240/102 R |

*Primary Examiner*—George H. Miller, Jr.
*Attorney, Agent, or Firm*—Salvatore G. Militana

[57] ABSTRACT

A burglar-proof guard for electric bulbs positioned in a socket having a peripheral shoulder consisting of a pivoted frame member mounted on the top portion of the bulb and a second pivoted frame member extending about the socket with three rods and a threaded bolt extending therebetween. Each of the pivoted frame members consist of a pair of semi-circular members with bores at the ends and at a mid-portion and the rods and bolt extending through the bores. The bolt is provided with a nut and a bore for receiving a lock preventing the removal of the guard from the light bulb without a key for the lock.

3 Claims, 5 Drawing Figures

BURGLAR-PROOF GUARD FOR LIGHT BULBS

BACKGROUND OF THE INVENTION

1. Field Of The Invention

This invention relates to guards for electric light bulbs and is more particularly directed to a burglar-proof guard.

2. Description Of The Prior Art

At the present time the guards available for preventing the unauthorized removal of electric light bulbs from a socket are expensive as they require a specially designed socket. There does not appear to be any guards that can be mounted directly on a conventional socket. With the recent increase in the crime rate and the great losses due to the theft of such items as light bulbs that are found outside the confines of ones homes, etc., there is a need for a burglar-proof guard that does not require an especially designed socket. At present, if a person wishes to prevent the theft of his outdoor electric light bulbs, he has to purchase a new socket and replace it for the one presently in use in order to utilize the burglar-proof guard that is available to him. The present invention contemplates avoiding this objection to the present burglar-proof guards.

SUMMARY OF THE INVENTION

Therefore, a principal object of the present invention is to provide a burglar-proof guard for electric light bulbs that can be mounted on the conventional sockets.

Another object of the present invention is to provide a burglar-proof guard for electric light bulbs which is simple in construction and readily mounted in position over a light bulb that can be locked to prevent the unauthorized removal of the bulb.

A further object of the present invention is to provide a burglar-proof guard for electric bulbs that does not block off any of the light emanating from the light bulb to reduce any of its efficiency.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
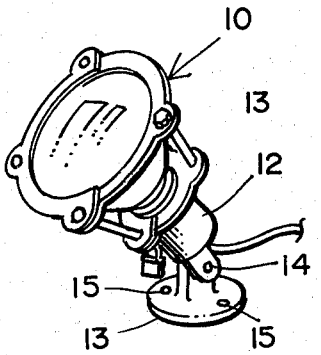
FIG. 1 is a perspective view of a burglar-proof guard shown mounted over a socket.
Figure 3:
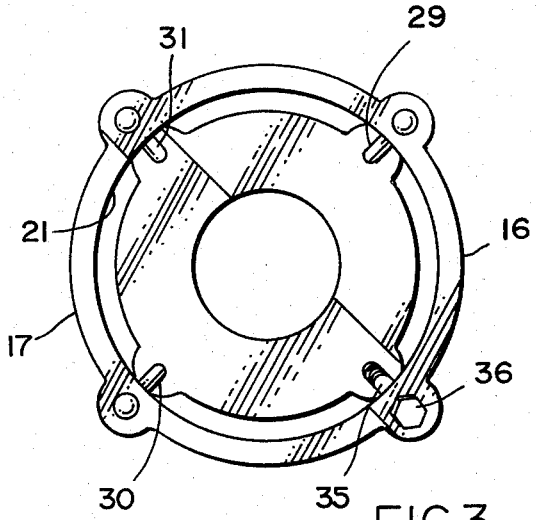
FIGS. 3 and 4 are top and bottom plan views respectively of my burglar-proof frames shown with the light bulb and socket removed.
Figure 5:
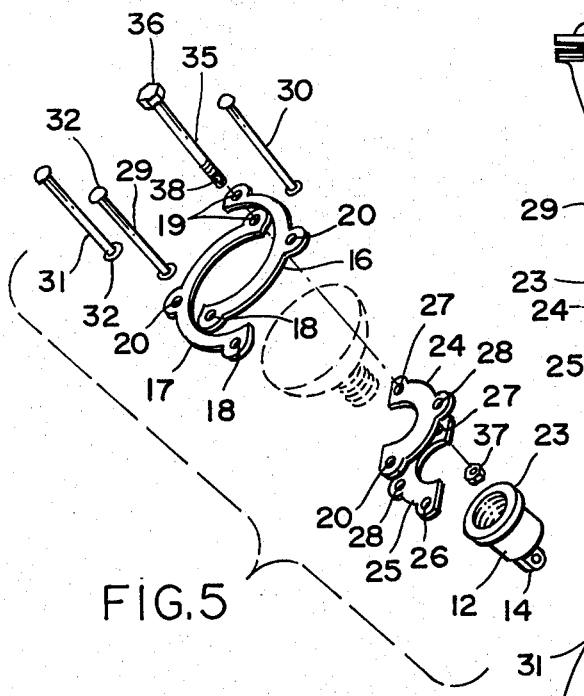
FIG. 5 is an exploded view.

Referring to the drawing wherein like numerals are used to designate similar parts throughout the several views, the numeral 10 refers to a burglar-proof guard for outdoor electric lights constructed in accordance with my invention shown mounted on an outdoor spotlight 11. The spotlight 11 is shown positioned in a conventional electric light socket 12 and mounting 13. The socket 12 is pivotally mounted to the mounting 13 as at 14 while the mounting 13 is provided with openings 15 for receiving screws and the like for fastening the light assembly to a wall, etc. The socket 12 is provided with a peripheral shoulder 23 extending about the top portion thereof.

My burglar-proof guard 10 for the electric light 11 consists of a pair of approximately semi-circular frame members 16 and 17 having bores 18 and 19 at the ends thereof and bore 20 at its mid-portion. When the bores 18, 18 and 19, 19 are in alignment, the frame members 16 and 17 form a circular frame having a circular opening 21 of smaller diameter than that of the top of the light bulb 11 so that the frame members 16 and 17 when assembled will bear against the top of the light bulb.

A somewhat similar pair of semi-circular frame members 24 and 25 forming a smaller circular frame structure is likewise provided with bores 26 and 27 at their end portions and bore 28 at the mid-portion. When the frame members 24 and 25 are assembled, the bores 26, 26 and 27, 27 will be aligned forming a central opening 40 for encircling the socket 12 engaging the peripheral shoulder 23.

Figure 2:
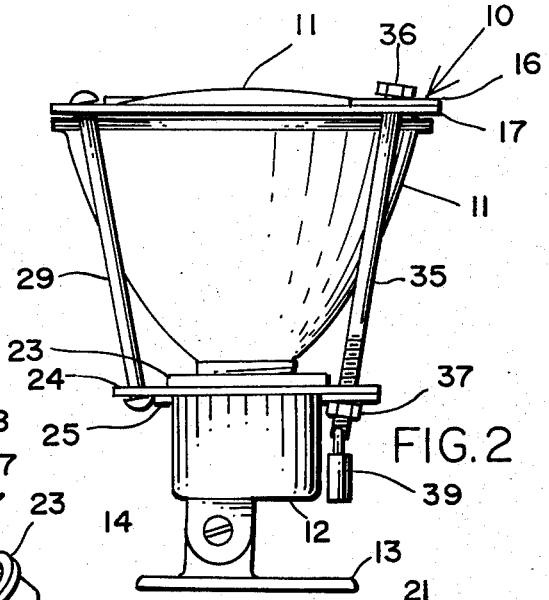
FIG. 2 is a side elevational view thereof.
Figure 4:
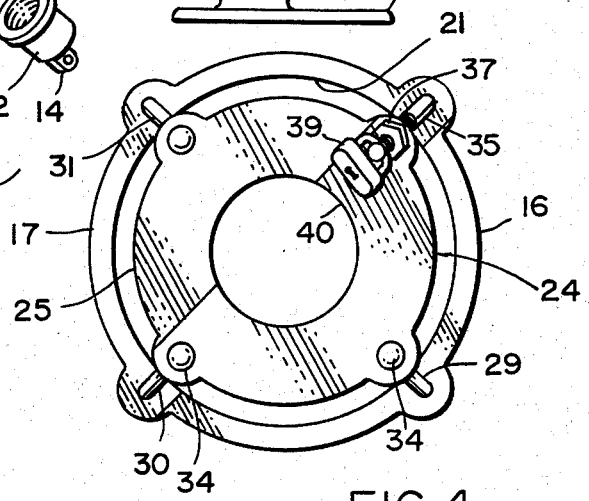

Three permanently mounted rods 29, 30 and 31 maintain the frame members 16, 17 and 24, 25 on the electric light 11. The rod 29 extends through aligned bores 18, 18 of the frame members 16 and 17 and aligned bores 26, 26 of the frame members 24 and 25. The rod 29 as well as rods 30 and 31 is provided with rivet type head portions 34 for permanent installation of the rods and frame members. Rod 30 extends through aligned bores 20 and 28, while rod 31 extends through the aligned bores 20 and 28. The aligned bores 19, 19 and 27, 27 receive a bolt 35 having a head 36 at one end and threaded at the other end for receiving a nut 37. At the threaded end of the bolt 35 is a bore 38 for receiving a lock 39 as shown by FIG. 2.

In the normal use of my burglar-proof guard for electric light bulbs, the nut 37 is unthreaded and removed from the bolt 35 and the latter removed from the frame members 16, 17 and 24, 25.

The frame members 16, 17 and 24, 25 are then swung outwardly on the rod 31 as a pivot to permit the frame members 24, 25 to encircle the socket 12 at the shoulder 23. The frame members 16, 17 will rest on the light bulb 11 and the frame members 16, 17 and 24, 25 are swung back to effect the alignment of the bores 19, 19 and 27, 27 so as to receive the bolt 35 therethrough. The nut 37 is threaded on the bolt 35 to compel the frame members 24, 25 to engage the shoulder 23 firmly. The lock 39 is then placed through the bore 38 to lock the frame 10 on the light bulb 11. Now, the only way that the light bulb 11 can be removed from the socket 12 is to unlock the lock 39, unthread and remove the nut from bolt 35 and remove the bolt 35 from the frames 16, 17 and 24, 25.

Having disclosed my invention, what I claim as new and desire to secure by Letters Patent is:

1. A burglar-proof guard for light bulbs having a socket and a peripheral shoulder mounted on said socket, comprising a first pair of substantially semi-circular frame members having aligned bores formed at their end portions, a second pair of substantially semi-circular frame members having aligned bores formed at their end portions, said first pair of frame members being adapted to be mounted on a light bulb and said second pair of frame members engaging said shoulder of said socket, rod means extending through said aligned bores of first and second frame members for securing said frame members together, one of said rod means having a bore at one end for receiving a lock for preventing the unauthorized removal of said light bulb from said socket.

2. The structure as recited by claim 1 wherein one of said rod means comprises a rod having rivet-type head portions at each end and a second rod means comprising a threaded bolt having an opening at the threaded end portion and a nut threaded on said bolt engaging one of said second frame.

3. The structure as recited by claim 2 wherein a further bore is formed in the mid-portion of each of said frame members, and a pair of further rods extending between said further bores of said first pair of frame members and said further bores of said second pair of frame members, said pair of further rods having rivet-type head portions.

* * * * *